US012729047B1

(12) United States Patent
Rao et al.

(10) Patent No.: US 12,729,047 B1
(45) Date of Patent: Sep. 8, 2026

(54) PACKAGING SYSTEMS AND METHODS

(71) Applicant: Rheem Manufacturing Company, Atlanta, GA (US)

(72) Inventors: Ashwin Vishwanath Rao, Montgomery, AL (US); Prudhvi Vishnu Vardhan Amaravadhi, Pike Road, AL (US); Marcus Deshune Paley, Round Rock, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 2 days.

(21) Appl. No.: 18/930,673

(22) Filed: Oct. 29, 2024

Related U.S. Application Data

(60) Provisional application No. 63/594,679, filed on Oct. 31, 2023.

(51) Int. Cl.

| | |
|---|---|
| ***B65D 81/107*** | (2006.01) |
| ***B65B 5/04*** | (2006.01) |
| ***B65D 77/04*** | (2006.01) |
| ***B65D 77/32*** | (2006.01) |
| ***B65D 85/68*** | (2006.01) |

(52) U.S. Cl.
CPC ..... *B65D 81/107* (2013.01); *B65B 5/04* (2013.01); *B65D 77/042* (2013.01); *B65D 77/32* (2013.01); *B65D 85/68* (2013.01); *B65D 2581/053* (2013.01); *B65D 2585/6857* (2013.01)

(58) Field of Classification Search
CPC ..... B65D 5/50; B65D 50/5052; B65D 65/44; B65D 85/64; B65D 85/68; B65D 81/05; B65D 81/107; B65D 77/042; B65D 77/32; B65D 2581/053; B65D 2585/6857; F24H 1/00; F24H 1/0018; F24H 1/0027; B65B 5/04
USPC ..... 206/320, 386, 523, 586, 591–592, 599, 206/108, 55.1, 229, 122.27, 125.22
See application file for complete search history.

(56) References Cited

U.S. PATENT DOCUMENTS

| | | | | |
|---|---|---|---|---|
| 1,817,286 A * | 8/1931 | Beaman | B65D 5/5033 | 206/592 |
| 1,821,307 A * | 9/1931 | Howland | B65D 5/326 | 229/199 |
| 1,852,832 A * | 4/1932 | Beaman | B65D 81/054 | 206/586 |
| 2,321,063 A * | 6/1943 | Bohnke | B65D 85/64 | 206/320 |

(Continued)

FOREIGN PATENT DOCUMENTS

| | | | | |
|---|---|---|---|---|
| CA | 2292227 C * | 10/2004 | B65D 75/004 | |
| CN | 110775416 A * | 2/2020 | B65D 25/54 | |

(Continued)

*Primary Examiner* — Orlando E Aviles
*Assistant Examiner* — Brijesh V. Patel
(74) *Attorney, Agent, or Firm* — Eversheds Sutherland (US) LLP

(57) ABSTRACT

A packaging system to pack an item is disclosed. The packaging system includes an inner box having a plurality of sidewalls. Each sidewall comprises an interior surface and an exterior surface. The inner box is configured to enclose side surfaces of the item. The packaging system further includes at least one spacer attached to the exterior surface of each sidewall. The packaging system further includes an outer box configured to enclose the inner box and the spacer of each sidewall.

18 Claims, 7 Drawing Sheets

(56) References Cited

U.S. PATENT DOCUMENTS 2,932,438 A * 4/1960 Smith ..... B65D 5/12 206/320
3,107,780 A * 10/1963 Stuckert ..... B65D 5/5038 206/521
3,161,339 A * 12/1964 Weller ..... B65D 5/5028 206/521
3,957,179 A * 5/1976 Bamburg ..... B65D 5/725 222/536
4,504,497 A * 3/1985 Kurth ..... B65D 5/566 229/125.21
4,621,736 A * 11/1986 Roccaforte ..... B65D 77/32 229/210
4,729,505 A * 3/1988 Remaks ..... B65D 5/566 229/4.5
4,742,951 A * 5/1988 Kelly ..... B65D 77/06 229/4.5
4,771,917 A * 9/1988 Heaps, Jr. ..... B65D 77/061 222/105
4,784,271 A * 11/1988 Wosaba, II ..... B65D 5/542 229/199
4,851,286 A * 7/1989 Maurice ..... B32B 5/18 206/523
4,871,345 A * 10/1989 Wosaba, II ..... B65D 77/32 493/67
4,877,139 A * 10/1989 Kim ..... B65D 77/32 229/238
4,881,641 A * 11/1989 Mattingly ..... B65D 85/68 206/320
4,919,306 A * 4/1990 Heaps, Jr. ..... B65D 77/061 229/122.34
4,955,474 A * 9/1990 Mattingly ..... B65D 85/68 206/320
5,307,928 A * 5/1994 Bishop ..... B65D 5/5033 206/320
5,351,849 A * 10/1994 Jagenburg ..... B65D 77/061 229/199
5,437,388 A * 8/1995 Bartelt ..... B65D 5/327 229/122.33
5,735,429 A * 4/1998 Whitworth ..... B65D 77/042 229/5.5
5,743,393 A * 4/1998 Webb ..... B65D 85/68 206/319
5,862,911 A * 1/1999 Phillips, II ..... B65D 75/004 206/320
6,092,654 A * 7/2000 Webb ..... B65D 5/5045 206/319
6,126,002 A * 10/2000 Brown ..... B65D 19/14 206/320
6,155,419 A * 12/2000 Sowa ..... B65D 75/004 206/320
6,237,838 B1 * 5/2001 Bradenbaugh ..... B65D 5/5002 206/320
6,786,394 B2 * 9/2004 Prince ..... B65D 77/065 229/117.28
6,834,792 B1 * 12/2004 Perkins ..... B65D 77/061 229/199
7,648,026 B2 * 1/2010 Brittain ..... B65D 85/30 206/320
7,654,390 B2 * 2/2010 Baechle ..... B65D 19/20 206/599
7,699,026 B2 * 4/2010 Gordon ..... F24H 1/182 122/494
8,061,521 B1 * 11/2011 Lowry ..... B65D 19/44 206/592
8,091,768 B2 * 1/2012 Wisecarver ..... B65D 5/60 229/125.22
9,714,774 B2 7/2017 Boros et al.
10,029,818 B2 * 7/2018 Kelly ..... B65D 19/0067
10,415,849 B2 9/2019 Boros et al.
10,451,303 B1 10/2019 Jasteh
10,480,824 B2 11/2019 Gardner et al.
10,571,153 B2 2/2020 Chaudhry et al.
10,677,494 B2 6/2020 Gardner et al.
11,073,303 B2 7/2021 Porwal et al.
11,098,924 B2 8/2021 Porwal et al.
11,208,253 B1 * 12/2021 Parella ..... B65D 81/05
11,293,667 B2 4/2022 Porwal et al.
11,346,578 B2 5/2022 Scott et al.
11,408,642 B2 8/2022 Gardner et al.
11,415,032 B2 8/2022 Jasteh et al.
11,428,438 B2 8/2022 Jasteh et al.
11,499,752 B2 11/2022 Chaudhry
11,505,393 B1 * 11/2022 Parella ..... B65D 81/05
11,536,464 B2 * 12/2022 Nolte ..... F24H 15/395
11,674,717 B2 6/2023 Chaudhry et al.
11,828,493 B2 11/2023 Porwal et al.
11,846,449 B2 12/2023 Rao et al.
11,852,059 B2 12/2023 Jasteh et al.
12,006,106 B2 6/2024 Paley
12,270,574 B2 4/2025 Gardner et al.
2011/0315749 A1 * 12/2011 Brittain ..... B65D 85/68 229/87.02
2012/0153785 A1 * 6/2012 Lai ..... B65D 5/5035 312/223.1
2013/0086373 A1 * 4/2013 Rothkopf ..... G06F 9/445 53/266.1
2018/0249071 A1 * 8/2018 Shiraishi ..... H04N 7/181
2019/0331389 A1 * 10/2019 Cummings ..... B65D 65/20
2022/0178583 A1 6/2022 Scott et al.
2022/0349621 A1 11/2022 Gardner et al.

FOREIGN PATENT DOCUMENTS

CN 212150019 U * 12/2020
CN 213975326 U * 8/2021
CN 219340440 U * 7/2023
EP 4245691 A1 * 9/2023 ..... B65D 85/64
FR 3021305 A1 * 11/2015 ..... B65D 85/68
JP 2006008191 A * 1/2006

* cited by examiner

PACKAGING SYSTEMS AND METHODS

CROSS-REFERENCE TO RELATED APPLICATIONS

The present application claims priority to and the benefit of U.S. provisional application No. 63/594,679, filed Oct. 31, 2023, which is hereby incorporated by reference herein in its entirety.

FIELD

The present disclosure relates to a packaging systems and methods and more specifically to packaging systems and methods for packaging appliances, including water heaters or Heating, Ventilation, and Air Conditioning (HVAC) systems and components.

BACKGROUND

Typically, appliances, such as water heaters or Heating, Ventilation, and Air Conditioning (HVAC) systems or components thereof, are packed using packaging assemblies before being transported from a manufacturing plant to respective destination locations. A conventional packaging assembly includes a cardboard box that encloses outer surfaces of an appliance to be packed. Some packaging assemblies may further include Expanded polystyrene or EPS to protect the appliances during transportation.

Conventional packaging assemblies may not provide adequate protection to the appliances during transportation. There are known instances of appliances receiving dents, scratches, operational issues, etc., even after being packaged in conventional packaging assemblies. Thus, there exists a need for an improved appliance packaging system that provides robust protection to appliances.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
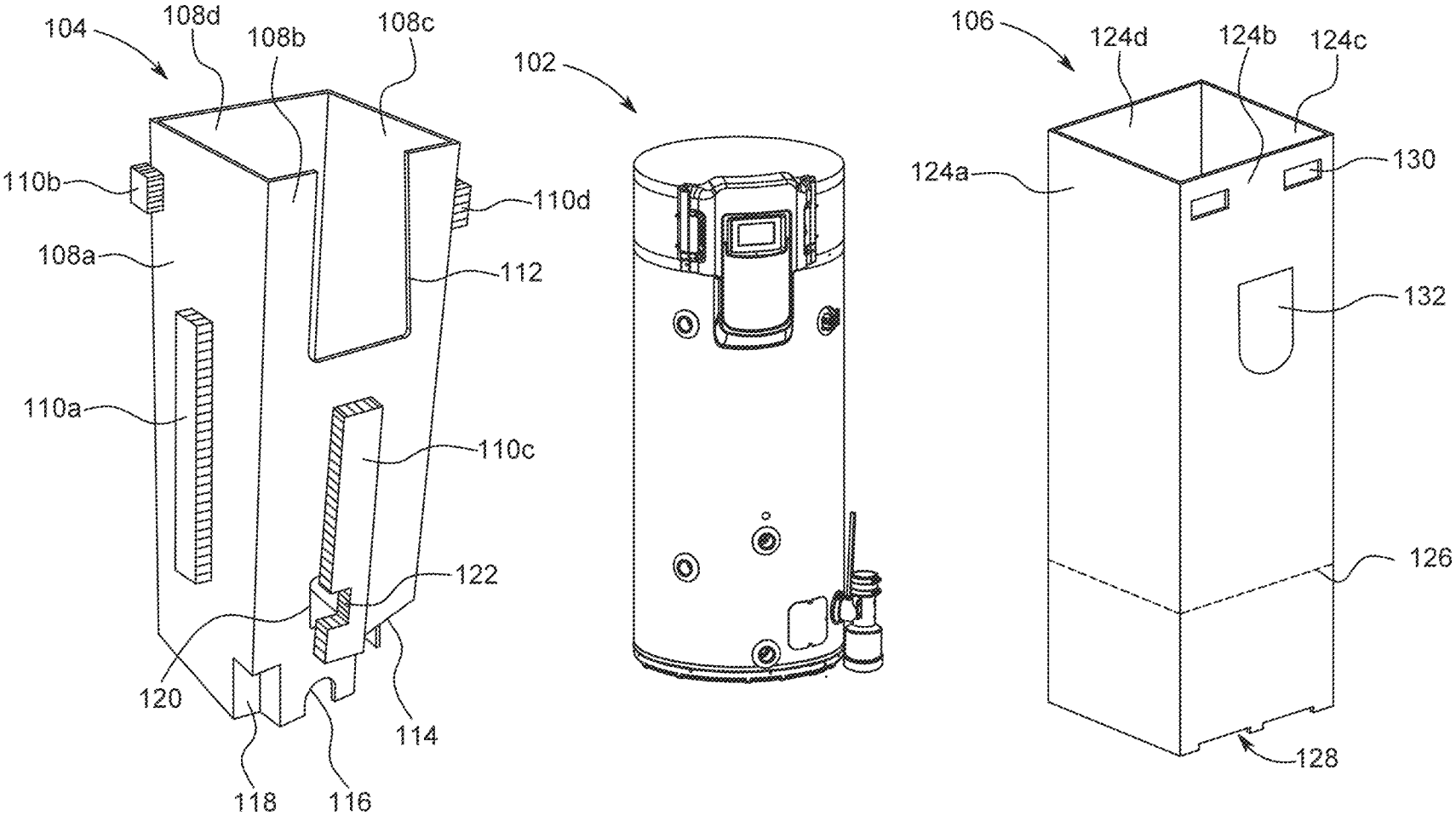
FIG. 1 depicts a disassembled packaging system and an item to be packaged in accordance with one or more embodiments of the present disclosure.

The present disclosure is directed to a packaging systems and methods configured to pack an item. The item may be, for example, a water heater, a Heating, Ventilation, and Air Conditioning (HVAC) system or any appliance or components thereof. The packaging system may include dual boxes (or dual wall corrugated sleeves) that may be used to enclose and pack the item. In an exemplary aspect, the packaging system may include an inner corrugated box and an outer corrugated box that may be used to pack the item. The inner corrugated box may be configured to enclose the item and the outer corrugated box may be configured to enclose the inner corrugated box, thus providing double-walled protection to the packed item. The packaging system may further include a plurality of spacers disposed between the inner corrugated box and the outer corrugated box, which may provide additional protection to the packed item. In some aspects, the spacers may be disposed at selected positions between the inner corrugated box and the outer corrugated box, e.g., based on the shapes and dimensions of the item to be packed or the shapes and dimensions of inner or outer corrugated boxes. In some instances, the spacers may be honey-comb corrugated supports or blocks (e.g., square or rectangular corrugated blocks).

In some aspects, the inner corrugated box may include a plurality of sidewalls, and each sidewall may include an interior surface and an exterior surface. The interior surface may face towards the item, and the exterior surface may be opposite to the interior surface. In certain embodiments, at least one spacer may be attached to the exterior surface of each sidewall. The spacers may be disposed anywhere on the exterior surface, for example, at a top portion, a middle portion, and/or a bottom portion of the exterior surface, based on the item or box shape and dimensions. In addition, the spacers may be disposed in any orientation at the exterior surface relative to an exterior surface longitudinal axis. For example, the spacers may be disposed vertically or horizontally on the exterior surface. The spacers may be any suitable size, shape, or configuration. For example, the spacers may be rectangular, square, triangles, spirals, curved, serpentine, circular, etc.

The packaging system may further include a pallet on which the item may be secured. In some aspects, the pallet may be a wooden pallet. The item may be removably secured on the pallet by using one or more brackets and screws to prevent movement of the item on the pallet when the packaging system including the item may be transported. In some aspects, the pallet may include a plurality of supports (e.g., corrugated supports) that may be disposed on a top surface of the pallet. The supports may be disposed on a boundary of the pallet and may be configured to robustly secure the item on the pallet.

In some aspects, each of the inner corrugated box and the outer corrugated box may further include one or more cut-outs that may enable a user to conveniently access portions/parts of the item placed in the inner corrugated box without having to remove the inner box and/or outer box from the item. In addition, the cut-outs may be configured to accommodate external or protruding parts or accessories associated with the item.

The present disclosure discloses a packaging system that facilitates shock absorption and protects the packed item during transportation. The packaging system enables a user to easily pack the item and access different portions/parts of the item without having to completely disassemble the packaging system. In addition, the packaging system is easy to disassemble (e.g., by using rip cords disposed on the inner corrugated box and/or the outer corrugated box). The packaging system is light-weight and facilitates easy transportation.

Although certain examples of the disclosed technology are explained in detail herein, it is to be understood that other examples, embodiments, and implementations of the disclosed technology are contemplated. Accordingly, it is not intended that the disclosed technology is limited in its scope to the details of construction and arrangement of components expressly set forth in the following description or illustrated in the drawings. The disclosed technology can be implemented in a variety of examples and can be practiced or carried out in various ways. In particular, the presently disclosed subject matter is described in the context of being a packaging system and method for conveniently packaging an item such as an appliance. The present disclosure, however, is not so limited, and can be applicable in other contexts. The present disclosure, for example and not limitation, can be applied to other items not limited to appliances. Such implementations and applications are contemplated within the scope of the present disclosure. Accordingly, when the present disclosure is described in the context of being a system and method for conveniently packaging appliances, it will be understood that other implementations can take the place of those referred to.

Turning now to the drawings, FIG. 1 depicts a disassembled packaging system and an item 102 to be packaged therein in accordance with one or more embodiments of the present disclosure. The packaging system may be configured to securely package the item 102 and provide protection to the item 102 from any damage, e.g., when the item 102 may be transported. While describing FIG. 1, reference will be made to FIGS. 2-4.

In some aspects, the item 102 may be an appliance, for example, a water heater, a Heating, Ventilation, and Air Conditioning (HVAC) system, a component thereof, and/or the like. The water heater may be a gas water heater, a heat pump water heater, a tankless water heater, a solar water heater, and/or the like. In other aspects, the item 102 may be any product different from an appliance.

The packaging system may include an inner box 104 and an outer box 106. The inner box 104 may be configured to surround or enclose the item 102, and the outer box 106 may be configured to surround or enclose the inner box 104. Stated another way, the item 102 may have a double-walled layer of protection. One layer of protection may be provided by the inner box 104 and a second layer of protection may be provided by the outer box 106. In some aspects, each of the inner box 104 and the outer box 106 may be corrugated boxes made of cardboard material (or paper pulp material). The inner box 104 and the outer box 106 may be separate components and may be separable. As described above, the inner box 104 and the outer box 106 may be configured to pack the item 102 to protect the item 102 during storage and transportation.

Figure 2:
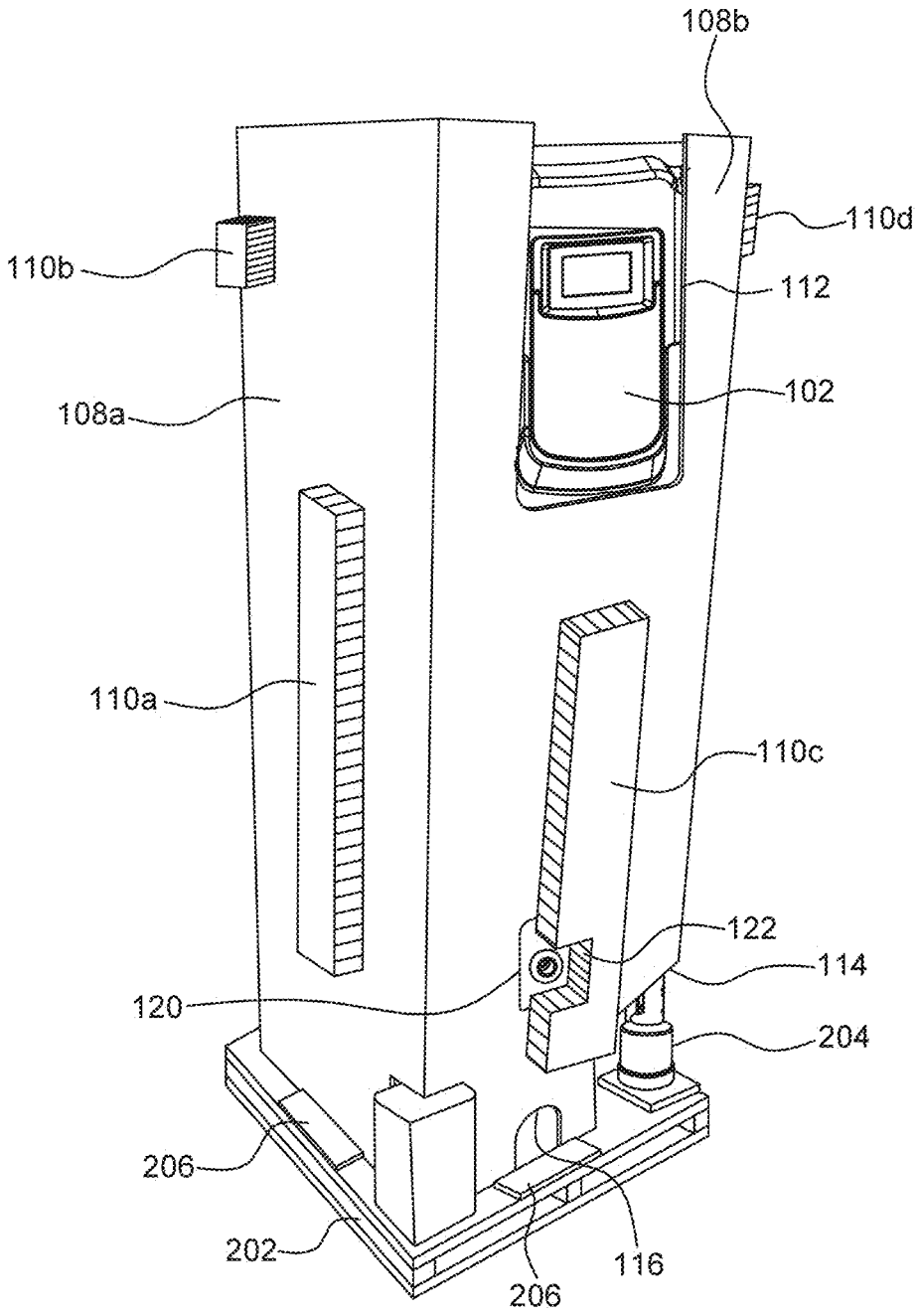
FIG. 2 depicts a partially assembled packaging system and the item of FIG. 1 in accordance with one or more embodiments of the present disclosure.

In some aspects, the inner box 104 may be a hollow corrugated box of any shape. In an exemplary aspect, the inner box 104 may have a cuboidal shape, as shown in FIGS. 1 and 2. The shape of the inner box 104 may depend on the shape of the item 102 to be packaged or enclosed in the inner box 104. The inner box 104 may include a plurality of sidewalls (e.g., sidewalls 108*a*, 108*b*, 108*c*, and 108*d* (collectively referred to as sidewalls 108) that may be configured to surround or enclose side surfaces or walls of the item 102. When the inner box 104 may be cuboidal in shape, the inner box 104 may include four sidewalls. Further, in some aspects, the inner box 104 may have an open top and bottom ends. In other aspects (not shown in FIGS. 1 and 2), the top end of the inner box 104 may be closed.

The inner box 104 may be configured to receive the item 102 and enclose the item 102 within the sidewalls 108 as depicted in FIG. 2. In an exemplary aspect, a user may slide the inner box 104 onto the item 102 via the open bottom end of the inner box 104 to enclose the item 102 within the sidewalls 108. The inner box 104 may be of any dimension depending on the size of the item 102. In an exemplary aspect, a height of each sidewall 108 may be greater than a height of the item 102 such that the inner box 104 may fully enclose the height of the item 102. Further, a width of each sidewall 108 may be greater than a width or radius (e.g., if the item 102 has a circular shape, as shown in FIG. 1) of the item 102 such that the inner box 104 may fully fit around the item 102.

As described above, the inner box 104 may include four sidewalls. In some instances, each sidewall 108 may be of same dimension and may include an interior surface (or an inner surface) and an exterior surface (or an outer surface). In other instances, each sidewall 108 may be different combinations of dimensions. The interior surface may face towards the item 102 when the inner box 104 encloses the item 102, and the exterior surface may face away from the item 102 (i.e., opposite to the interior surface). Further, each sidewall 108 may have the same thickness, which may be in a range of, e.g., 0.5 to 3 centimeters. In other instances, each sidewall 108 may have different thicknesses.

The packaging system may further include a plurality of spacers 110*a*, 110*b*, 110*c*, 110*d* (collectively referred to as spacers 110) that may be attached to the exterior surfaces of the sidewalls 108 of the inner box 104. In some aspects, the spacers 110 may be honey-comb corrugated supports or blocks (e.g., square, rectangular, circular or elliptical shaped blocks) made of similar material as the inner box 104 and the outer box 106. The honey-comb corrugated support may include a series of cells (such as hexagon-shaped cells) sandwiched between two thin cardboard sheets (e.g., a first sheet and a second sheet of each spacer 110). In an embodiment, the first sheet of each spacer 110 may contact or be attached with (e.g., by using an adhesive or a fastening member) the exterior surface of the sidewall 108, and the second sheet of each spacer 110 may face away from the exterior surface of the sidewall 108. In some aspects, when the inner box 104 may be enclosed by the outer box 106, the second sheet of each spacer 110 may face and/or be in contact with an interior surface of the outer box 106. Stated another way, the spacers 110 may be disposed between the exterior surfaces of the sidewalls 108 of the inner box 104 and the interior surfaces of the outer box 106. The spacers 110 may provide additional protection to the item 102 from damage during transportation, e.g., when the item 102 may be enclosed by the inner box 104 (and the outer box 106 that encloses the inner box 104). The spacers 110 may form or maintain a space between the inner box 104 and the outer box 106.

In some aspects, each sidewall 108 may include at least one spacer at the exterior surface of the sidewall 108 to provide protection to the item 102. In the exemplary aspect depicted in FIG. 1, the sidewall 108*a* includes two spacers 110*a*, 110*b*, the sidewall 108*b* includes one spacer 110*c*, and the sidewall 108*c* includes two spacers including the spacer

110*d*. Similarly, the sidewall 108*d* includes one or more spacers that are not shown in FIG. 1.

Although FIGS. 1 and 2 depict the sidewalls 108 as having one or two spacers, each sidewall 108 may include any number of spacers without departing from the scope of the present disclosure. Further, the spacers 110 may be arranged/disposed in any location and/or in any orientation on the different sidewalls 108. In further aspects, one or more spacers may additionally or alternatively be disposed on the interior surfaces of one or more sidewalls 108.

As described above, the spacers 110 may be disposed anywhere on the exterior surfaces of the sidewalls 108. In some aspects, one or more of the spacers 110 may be disposed on a middle portion of each sidewall 108. Further, one or more of the spacers 110 may be disposed at a top portion and/or a bottom portion of each sidewall 108. For example, the spacer 110*a* and 110*c* may be disposed at a middle portion of the sidewalls 108*a* and 108*b* respectively, and the spacers 110*b* and 110*d* may be disposed at a top portion of the sidewalls 108*a* and 108*c*. Furthermore, some spacers 110 (e.g., the spacers 110*a* and 110*c*) may be disposed at a center point of each sidewall 108 such that each spacer 110 may be equidistant from the side edges of the sidewall 108. In other aspects, some spacers (e.g., the spacers 110*b* and 110*d*) may be disposed in proximity to the edges of the sidewalls 108 (e.g., on opposite edges of the sidewalls 108*a* and 108*c*).

Further, as described above, the spacers 110 may be disposed in any orientation on the exterior surfaces of the sidewalls 108. For example, the spacers 110 may be disposed vertically on the exterior surfaces of the sidewalls 108 such that a longitudinal axis of each spacer 110 may be parallel to a longitudinal axis of each sidewall 108 (e.g., when the spacers 110 may be rectangular). In other aspects, one or more of the spacers 110 may be disposed horizontally on the exterior surfaces of the sidewalls 108 such that the longitudinal axis of each spacer 110 may be perpendicular to the longitudinal axis of each sidewall 108. In yet another aspect, some spacers 110 may be disposed horizontally and some spacers 110 may disposed vertically on the same sidewall or on different sidewalls of the inner box 104. In other instances, one or more of the spacers 110 may be disposed diagonally along each side wall 108.

Each spacer 110 may be of any size, shape, or dimension depending on the dimensions of the inner box 104/sidewalls 108. In some aspects, the spacers 110 may be shaped as rectangular blocks and disposed vertically on the sidewalls 108, and a height of each spacer 110 may cover 10-70% of a height of each sidewall 108, and a width of each spacer 110 may cover 5-50% of a width of each sidewall 108. In an embodiment, each sidewall 108 may have a height in a range of 60-70 inches and a width in a range of 20-30 inches, and a height of the spacers 110*a* and 110*c* may be in a range of 30-35 inches, and a width in a range of 3-10 inches. In further aspects, the spacers 110*b* and 110*d* may have a height in a range of 2-10 inches and a width in a range of 3-10 inches.

Furthermore, each spacer 110 may have any thickness. In an exemplary aspect, the thickness of each spacer is in a range of 1-3 inches. In some aspects, the dimensions of all the spacers 110 may be same. In other aspects, dimensions of one or more spacers may be different from the dimensions of the remaining spacers. For example, the spacer 110*a* and the spacer 110*c* may have same lengths and/or widths, and the spacers 110*a* and 110*b* may have different lengths and/or widths.

The inner box 104 may further include one or more cut-outs that may be used to enable the user to access one or more portions of the item 102 when the inner box 104 encloses the item 102. For example, the inner box 104 may include a cut-out 112 on the sidewall 108*b*. In some aspects, the cut-out 112 may be disposed at a top portion of the sidewall 108*b*. The cut-out 112 may enable the user to access a front top portion (or any other portion) of the item 102. For example, the cut-out 112 may enable the user to apply/change labels on the item 102 that may be disposed on a front top portion of the item 102. The cut-out 112 may be of any dimension depending on the shape and configuration of the item 102. As an example, the cut-out 112 may have a height in a range of 5-30% of the height of the sidewall 108*b* and a width in a range of 30-70% of the width of the sidewall 108*b*.

Although FIG. 1 depicts the cut-out 112 as being disposed on the sidewall 108*b*, in other aspects, the cut-out 112 may be disposed on any other sidewall 108*a*, 108*c*, or 108*d*. Furthermore, the inner box 104 may include more than one cut-out 112.

In further aspects, the inner box 104 may include one or more additional cut-outs to accommodate one or more parts or accessories associated with the item 102. For example, the inner box 104 may include a cut-out 114 that may be disposed on bottom portions (e.g., at a corner of the bottom portions) of the sidewalls 108*b* and 108*c* to accommodate an accessory associated with the item 102 (e.g., a condensate neutralizer of a water heater, when the item 102 is a water heater). The inner box 104 may further include one or more additional cut-outs 116, 118, and 120 to enable access to other parts of the item 102. In an exemplary aspect, the cut-out 116 may be for a drain valve clearance associated with the water heater, and the cut-out 118 may be for an exhaust tee clearance associated with the water heater. In some aspects, the spacers 110 may also include one or more cut-outs (such as a cut-out 122) to enable users to access some parts of the item 102. The cut-out 122 may be aligned with the cut-out 120.

The cut-outs 112, 114, 116, 118, and 120 described above may be disposed at any position on the sidewall 108*b* or on any sidewall of the inner box 104 depending on the shape, dimensions, and configuration (e.g., positions of protruding parts to be accommodated in the inner box 104) of the item 102.

As described above, the outer box 106 may be configured to surround/enclose (e.g., completely enclose) the inner box 104 and the spacers 110 when the outer box 106 is placed around the inner box 104 and the spacers 110. In an exemplary aspect, the user may first slide the inner box 104 (including the spacers 110 attached on an outer surface thereof) over the item 102 to enclose the item 102 within the inner box 104 and then slide the outer box 106 over the inner box 104 to enclose the inner box 104 and the spacers 110 within the outer box 106. In some instances, the size and shape of the outer box 106 may be configured to abut the outer surface of the spacers 110 when the outer box 106 is placed around the inner box 104 and the spacers 110.

The outer box 106 may be a hollow corrugated box of any shape depending on the shape of the inner box 104. For example, the outer box 106 may be cuboidal in shape when the inner box 104 may be cuboidal. The outer box 106 may include a plurality of sidewalls (e.g., sidewalls 124*a*, 124*b*, 124*c*, and 124*d* shown in FIG. 1, collectively referred as sidewalls 124) that may be configured to surround or enclose the sidewalls 108 of the inner box 104. In some aspects, the outer box 106 may include four sidewalls when the outer box 106 may be cuboidal in shape with an open top and bottom ends. The outer box 106 (specifically the sidewalls of the outer box 106) may be of any size, shape, and dimension. In an exemplary aspect, a height of each sidewall 124 of the outer box 106 may be equivalent to or greater than the height of each sidewall 108 of the inner box 104. Additionally, a width of each sidewall 124 of the outer box 106 may be slightly greater than the width of each sidewall 108 (or equal to a width of the side wall 108 and spacer 110 combined) so that the outer box 106 may conveniently accommodate and enclose the inner box 104 and the spacers 110. A fully assembled view of the packaging system, with the outer box 106 completely enclosing the inner box 104 and the spacers 110 (and the inner box 104 enclosing the item 102) is shown in in FIG. 4.

As described above, the outer box 106 may include four sidewalls when the outer box 106 is cuboidal in shape. Each sidewall 124 may include an interior surface and an exterior surface. The interior surface of the outer box 106 may face towards the spacers 110 (and the item 102) and the exterior surface may face away from the spacers 110 and the item 102 (i.e., be opposite to the interior surface). As described above, in some aspects, the interior surface of the outer box 106 may contact (e.g., abut) the spacers 110. Alternatively, in other aspects, the interior surface of the outer box 106 may not contact the spacers 110 and may be disposed at a predefined distance (e.g., in a range of 0.1-0.5 centimeters) from the spacers 110.

In further aspects, the inner box 104 and/or the outer box 106 may include one or more rip cords that may enable the user to conveniently disassemble the packaging system (e.g., at a time of installation of the item 102). In the exemplary aspect depicted in FIG. 1, the outer box 106 is shown to include a rip cord 126 at a bottom portion of the sidewalls 124. The present disclosure is not limited to such an arrangement of the rip cord 126, and the rip cord 126 may be disposed anywhere on the sidewalls 124, and/or the outer box 106 may include more than one rip cord 126. Further, although no rip cord is shown in the inner box 104 in FIG. 1, in some aspects, the inner box 104 may also include one or more rip cords.

Similar to the inner box 104, the outer box 106 may also include one or more cut-outs. For example, as shown in FIG. 1, the sidewall 124*b* may include one or more cut-outs 128 at a bottom portion on the sidewall 124*b* (or any other sidewall of the outer box 106). The sidewall 124*b* may further include additional cut-outs 130 that may be disposed at a top portion of the sidewall 124*b* (or any other sidewall of the outer box 106). The cut-outs 130 may enable convenient handing and movement of the packaging system enclosing the item 102 during transportation.

The outer box 106 may additionally include a flap 132 (or a removable panel) disposed at the top portion or a middle portion of the sidewall 124*b*. The flap 132 may be aligned with the cut-out 112 included in the inner box 104 and may enable the user to access the front top portion of the item 102 without having to remove the outer box 106 and the inner box 104. In some aspects, the flap 132 may be configured to create an opening on the top portion of sidewall 124*b*, which may be used to access the cut-out 112 and hence the front top portion of the item 102. For example, the flap 132 may include a number of perforations about at least a portion of a perimeter (e.g., the sides and bottom perimeter) of the flap 132. When pulled or pushed on, the perforations may disengage at least a portion of the flap 132 from the sidewall 124*b*, which may allow the flap 132 to be removed (or in other instances, folded upward to access the item 102 via the cut-out 112.

In additional aspects, the packaging system may include a pallet 202 on which the item 102 and the accessories (such as a condensate neutralizer 204) associated with the item 102 may be disposed, as shown in FIG. 2. In some instances, the pallet 202 may be a wooden pallet and may act as a small portable platform for storage and movement of the item 102. The pallet 202 may be of any suitable size, shape, and dimension depending on the shapes and dimensions of the item 102, the inner box 104, and the outer box 106. For example, the pallet 202 may be rectangular or square in shape when the inner box 104 and the outer box 106 are cuboidal in shape.

In some aspects, the pallet 202 may include a plurality of supports 206 disposed on a top surface of the pallet 202. The plurality of supports 206 may be corrugated blocks that may be disposed at a boundary or edges of the pallet 202 (e.g., at four edges/corners) and may be configured to surround a base portion (or the bottom portion) of the item 102. In an exemplary aspect, the pallet 202 may have four supports, and one support may be disposed in proximity to each edge of a square or rectangular-shaped pallet 202. In some aspects, the supports 206 may be disposed at a middle portion of respective edges of the pallet 202. The supports 206 may further enable the user to determine the center of the pallet 202 so that the user may conveniently and correctly place the item 102 at the center of the pallet 202. Each support 206 may be of any suitable size, shape, or dimension depending on the dimensions of the pallet 202. In an exemplary aspect, each support 206 may have a length in a range of 10-60% of a length of an edge of the pallet 202 and a width in a range of 10-50% of the length of the support 206.

Figure 3:
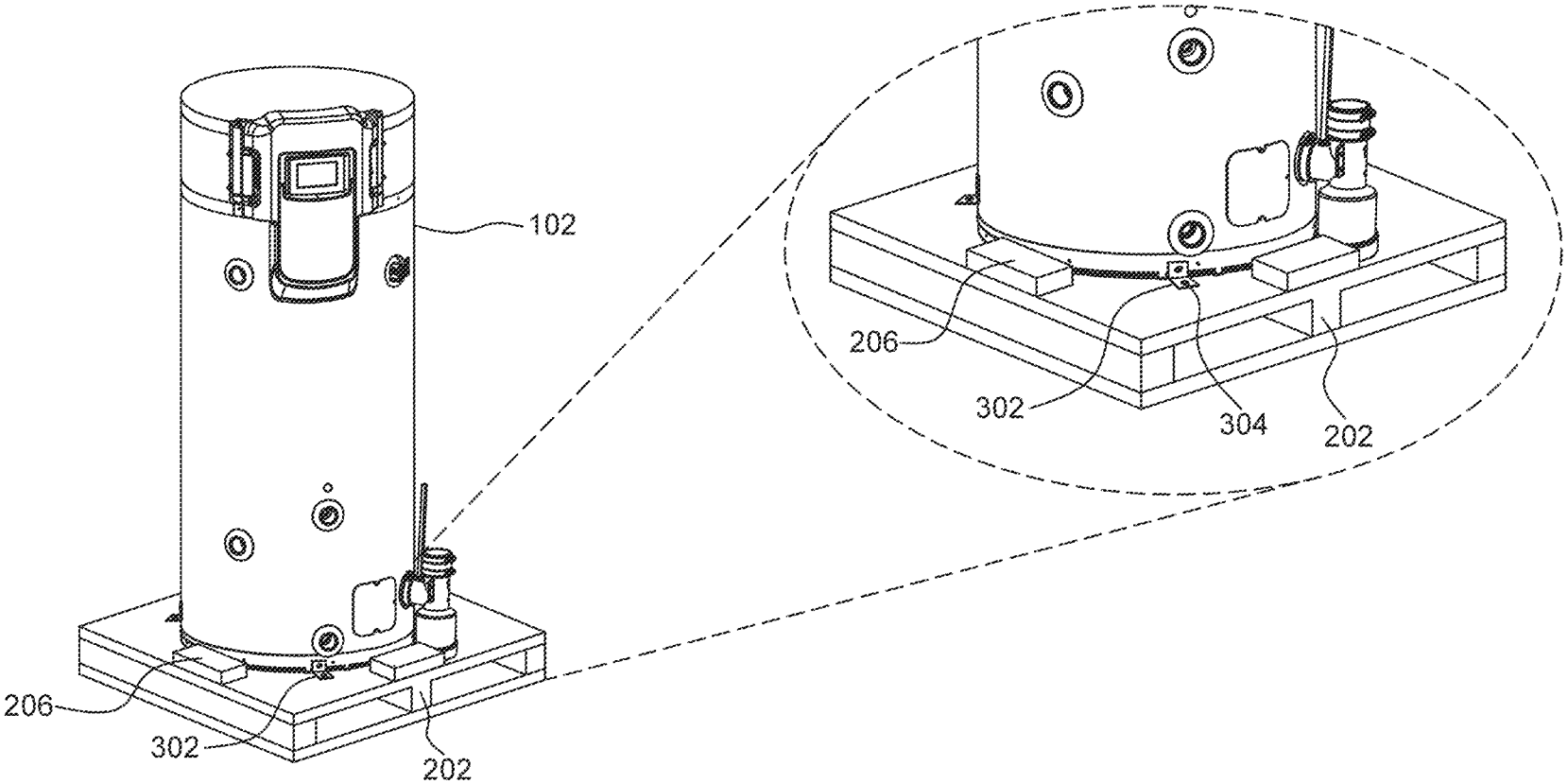
FIG. 3 depicts an attachment of an item with a pallet in accordance with one or more embodiments of the present disclosure.
Figure 4:
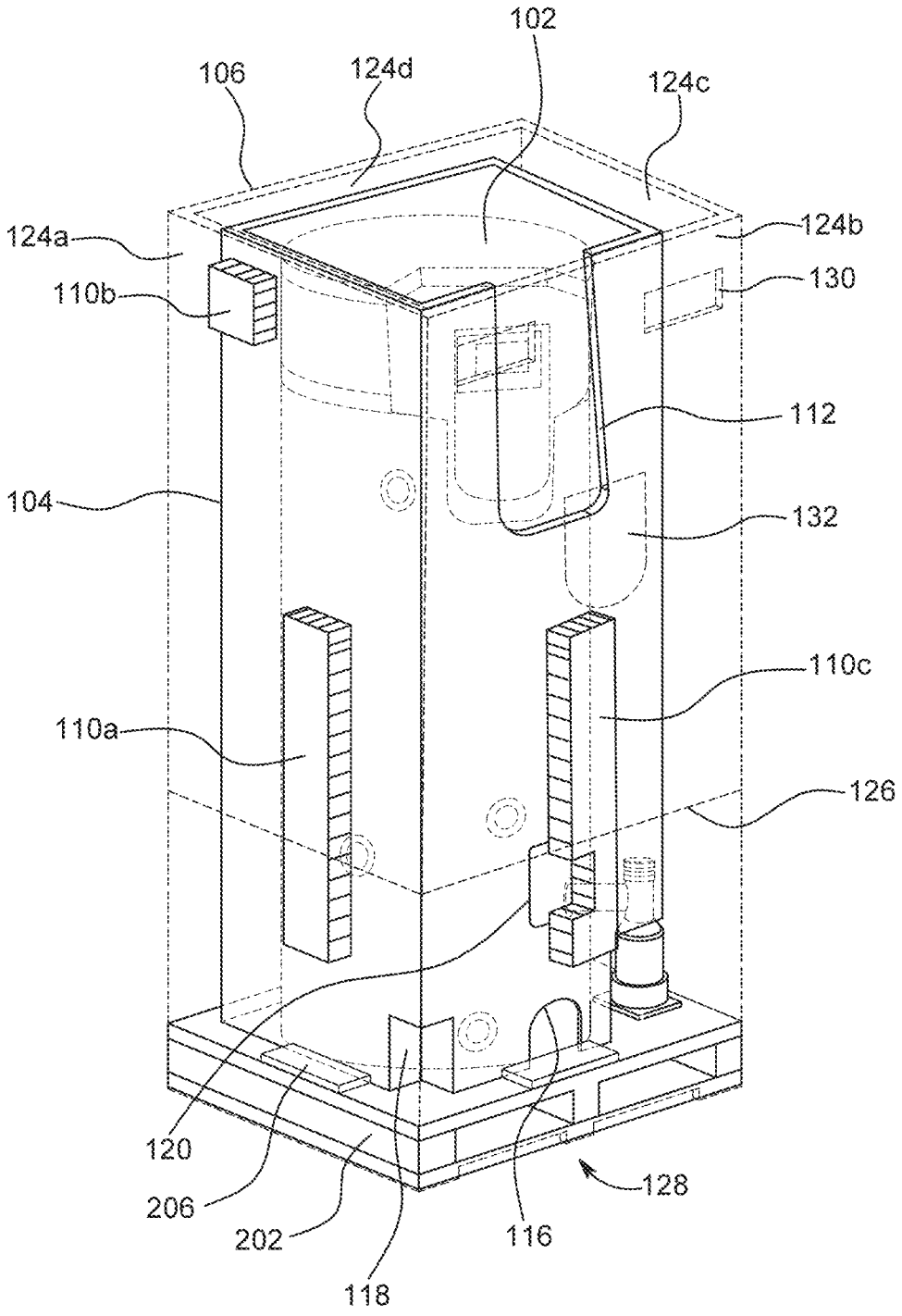
FIG. 4 depicts a completely assembled packaging system and the item of FIG. 1 in accordance with one or more embodiments of the present disclosure.

In some aspects, the item 102 may be removably attached to the pallet 202 by using one or more fastening members. For example, the item 102 may be attached to the pallet 202 using a plurality of brackets 302 and screws 304, as shown in FIG. 3. In an embodiment, the item 102 may be attached to the pallet 202 by using four pairs of brackets and screws. As described above, the item 102 may be attached at the center of the pallet 202 and surrounded by the supports 206 to enable secure attachment of the item 102 and the pallet 202.

In additional aspects, the packaging system may include a top cap that may be configured to cover a top surface of the item 102. The top cap may be a corrugated cap and may protect the top surface of the item 102 from any damage during transportation. In some instances, the top cap may include an inner wall, spacers, and an outer wall as described above.

During operation, the user may place/attach the item 102 to the pallet 202. As described above, the item 102 may be disposed on the center of the pallet 202 such that the supports 206 may surround the bottom portion of the item 102. After the item 102 is disposed on the pallet 202, the item 102 may be attached to the pallet 202 by using the fastening members (e.g., the brackets 302 and the screws 304). When the item 102 is secured on the pallet 202, the item 102 may be covered or enclosed by the inner box 104 (e.g., the side surfaces of the item 102 may be secured by the inner box 104). In some aspects, the inner box 104 may be placed around the item 102 (i.e., surround the side surfaces of the item 102) by sliding the inner box 104 from the top portion of the item 102 towards the bottom portion of the item 102 and then positioning the inner box 104 on the top surface of the pallet 202. In some aspects, the inner box 104 may be positioned on the top surface of the pallet 202 such that the inner box 104 may partially cover the supports 206. In an exemplary aspect, the inner box 104 may contact a top surface of the supports 206 when the inner box 104 may be positioned on the top surface of the pallet 202.

When the inner box 104 is disposed on the pallet 202, the outer box 106 may be placed around the inner box 104 (e.g., to surround the exterior surfaces of the inner box 104) by sliding the outer box 106 from the top portion of the inner box 104 towards the bottom portion of the inner box 104. When the outer box 106 is placed around the inner box 104, the top cover may be placed over the outer box 106, thus arranging the packaging system in a fully assembled state. The item 102 may be transported to its destination location when the packing system may be arranged in the fully assembled state.

Figure 5:
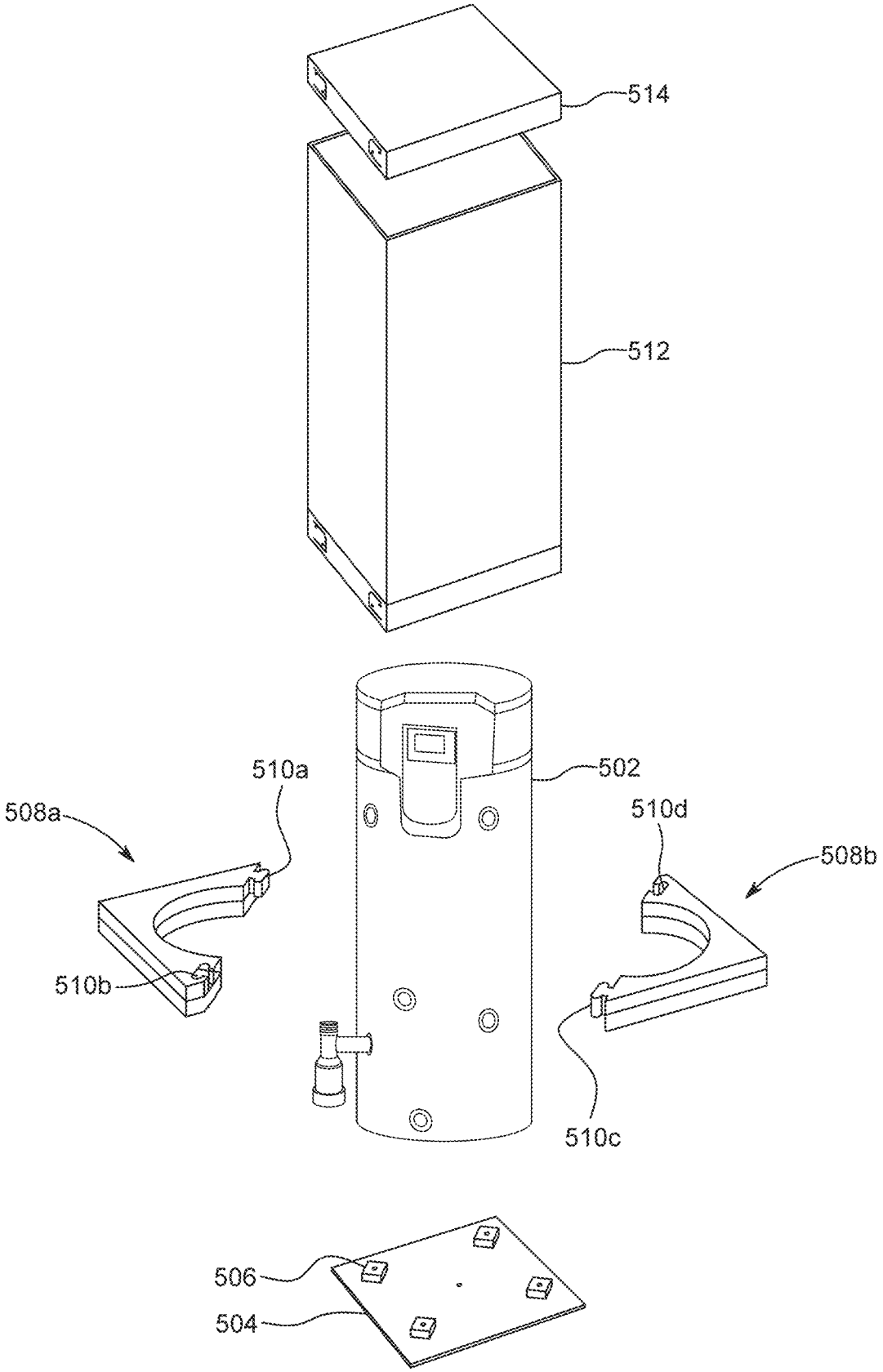
FIG. 5 depicts an embodiment of a disassembled packaging system and an item to be packaged in accordance with one or more embodiments of the present disclosure.

FIG. 5 depicts a view of another embodiment of a packaging system and an item 502 in accordance with the present disclosure. In some aspects, the item 502 may be same as the item 102. While describing FIG. 5, references will be made to FIG. 6.

The packaging system may include a pallet 504 that may be same as the pallet 210. The pallet 504 may include a plurality of supports 506 disposed on the top surface of the pallet 504 and placed in proximity to a boundary or edges of the pallet 504. The supports 506 may be same as the supports 206 described above. The item 502 may be secured on the pallet 504 in the same manner as the item 102 is secured on the pallet 202 described above (e.g., by using brackets and screws).

In some aspects, the packaging system may further include a spacer 508*a* and 508*b* (collectively referred as spacer 508) that may be positioned around the item 502 (e.g., to enclose the side surfaces of the item 502). In some aspects, the spacer 508 may be disposed on a middle portion of the side surface of the item 502. Alternatively, the spacer 508 may be disposed on a top/bottom portion of the side surface of the item 502. The spacer 508 may be a honeycomb support/insert. In some aspects, the spacer 508 may include a first part 508*a* and a second part 508*b* that may be configured to removably connect with each other to form a square block with a hole in the middle (as an example). The first part 508*a* may cover a first side portion (e.g., a left side portion) of the item 502, and the second part 508*b* may cover a second side portion (e.g., a right side portion) of the item 502. Each of the first part 508*a* and the second part 508*b* may be "V-shaped" parts having a semi-circular cavity such that the first part 508*a* and the second part 508*b* may form a circular opening when the first part 508*a* may be connected with the second part 508*b*. The circular opening may enable the spacer 508 to enclose the item 502 (e.g., when the item 502 may be having a cylindrical outer surface or cylindrical shape). In some aspects, a center of the opening may coincide with a center of the item 502 to enable stable attachment of the spacer 508 around the item 502. In addition, a radius of the opening may be equivalent to or greater than a radius of the item 502.

In some aspects, the first part 508*a* and the second part 508*b* may include corresponding dovetail ends that may enable the user to removably attach the first part 508*a* with the second part 508*b*. For example, the first part 508*a* may include a first protrusion 510*a* at one end and a first recess 510*b* at another end, and the second part 508*b* may include a second protrusion 510*c* at one end and a second recess 510*d* at another end. The first protrusion 510*a* may be configured to be inserted in the second recess 510*d* and the second protrusion 510*c* is configured to be inserted in the first recess 510*b*, to enable attachment between the first part 508*a* and the second part 508*b*.

Figure 6:
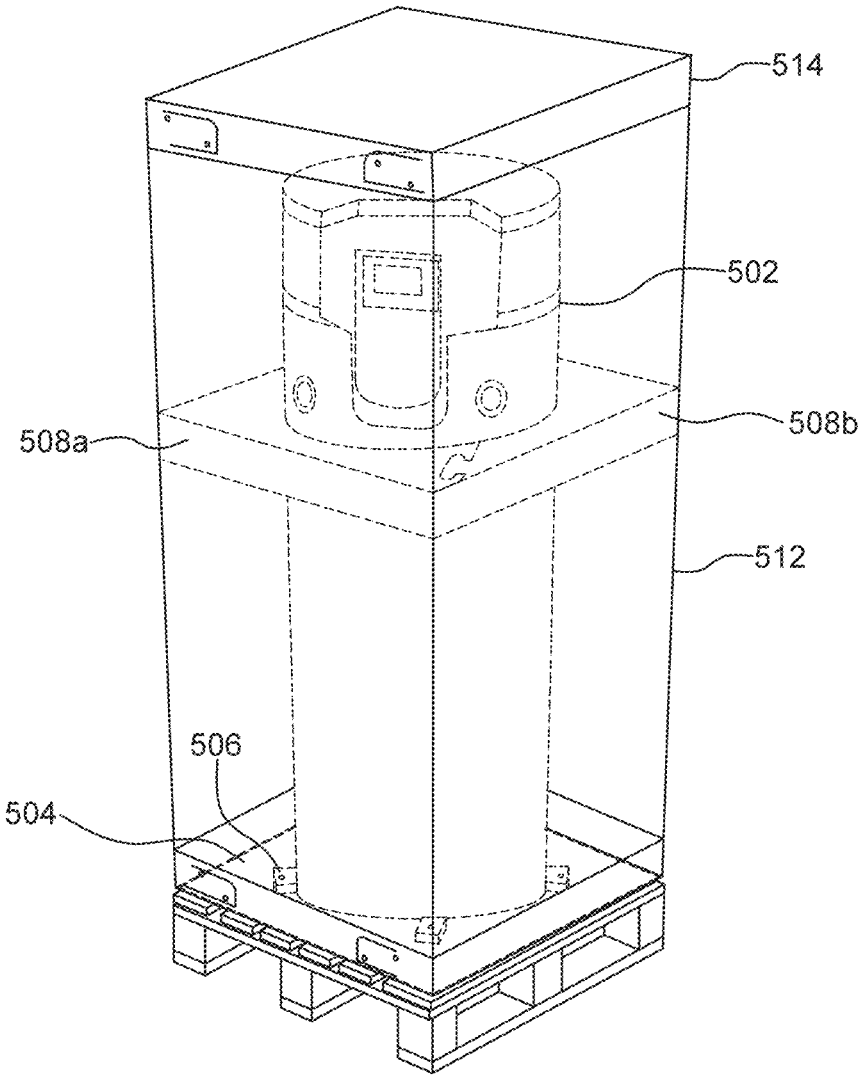
FIG. 6 depicts an assembled packaging system and the item of FIG. 5 in accordance with one or more embodiments of the present disclosure.

The packaging system may further include a box 512 that may be configured to cover or enclose the item 502 and the spacer 508 when the spacer 508 are disposed around the item 502. In some instances, the box 512 may be a corrugated box and may be the same as the inner box 104 and may be configured to be placed on the pallet 504. For example, the box 512 may include a number of spacers 110 disposed on an outer surface thereof as described above. In this manner, the spacer 508 may be disposed within and surrounded by the box 512. In this instance, another box, similar to outer box 106, may then be placed over and around the box 512 and the spacers 110 attached thereto. In other instances, the box 512 may be a corrugated box and may be the same as the outer box 106 and may be configured to be placed on the pallet 504. The packaging system may further include a top cover 514 that may be configured to cover a top portion of the item 502 when the box 512 is placed over the item 502. The top cover 514 (or the top cap) may also be a corrugated box. An assembled view of the packaging system and the item 502 is shown in FIG. 6.

Figure 7:
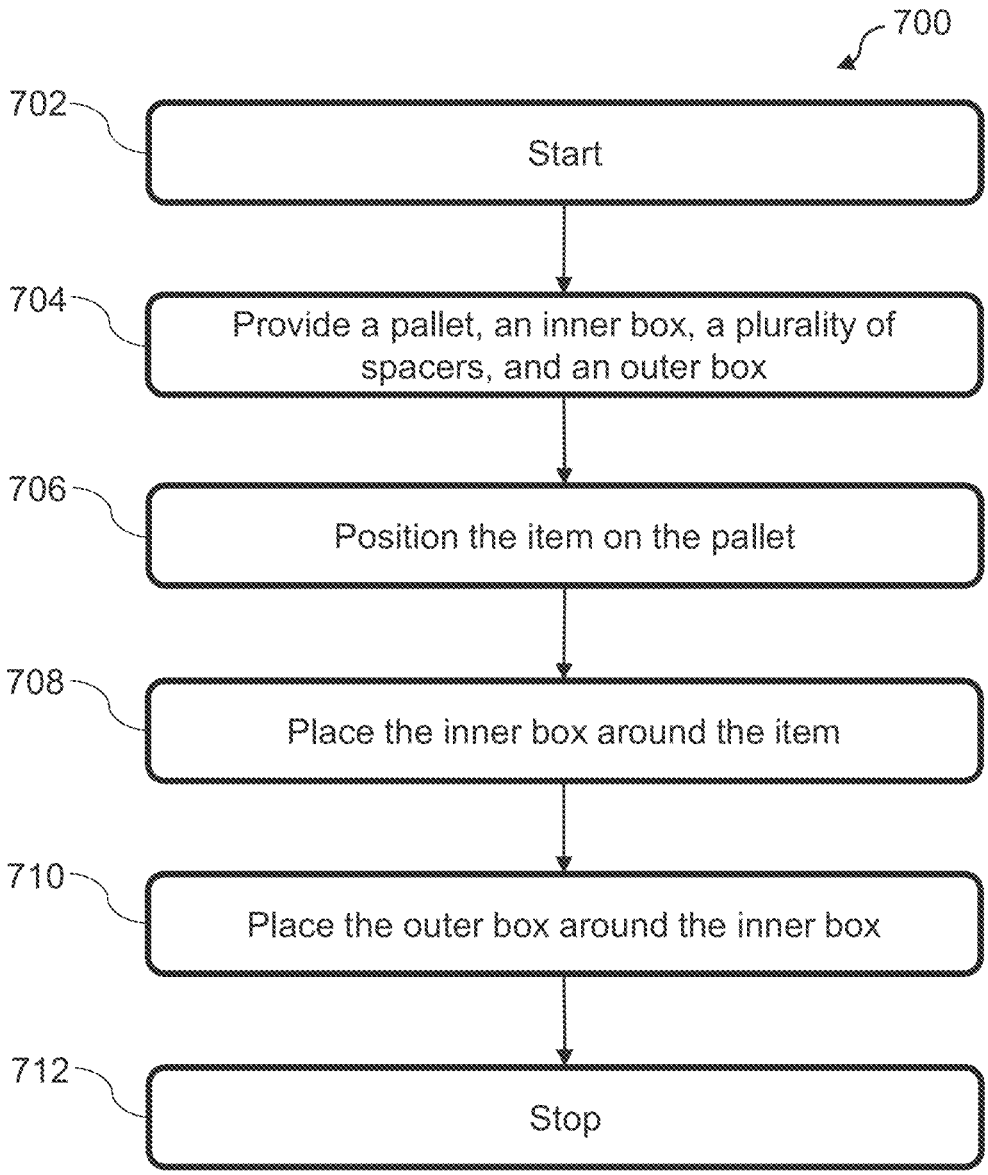
FIG. 7 depicts a flow diagram of a method to pack an item in accordance with one or more embodiments of the present disclosure.

FIG. 7 depicts a flow diagram of a method 700 to pack the item 102 in accordance with one or more embodiments of the present disclosure. FIG. 7 may be described with continued reference to prior figures, including FIGS. 1-6. The following process is exemplary and not confined to the steps described hereafter. Moreover, alternative embodiments may include more or less steps than are shown or described herein and may include these steps in a different order than the order described in the following example embodiments.

The method 700 starts at step 702. At step 704, the method 700 may include providing the pallet 202, the inner box 104, the spacers 110, and the outer box 106. As described above, the inner box 104 may include the sidewalls 108 configured to surround/enclose side surfaces of the item 102. Each sidewall 108 may include an interior surface and an exterior surface, and the spacers 110 may be attached to the exterior surfaces of the sidewalls 108. The outer box 106 may be configured to surround/enclose the inner box 104 and the spacers 110.

At step 706, the method 700 may include positioning the item 102 on the pallet 202. In some aspects, the item 102 may be secured on the pallet 202 by using the brackets 302 and the screws 304. At step 708, the method 700 may include placing the inner box 104 around the item 102 (e.g., to cover/enclose outer side surfaces of the item 102). At step 710, the method 700 may include placing the outer box 106 around the inner box 104 (e.g., to cover/enclose outer side surfaces of the inner box 104). In some instances, the spacer 508 may optionally be disposed around the item 102 prior to putting the inner box 104 around the item 102.

The method 700 stops at step 712.

Examples of tests using the packaging system are described below. The examples are for illustrative purpose only and should not be construed as limiting or exhaustive. The packed item was inspected before testing to determine the condition of the item.

A first testing procedure included a compression test to evaluate an amount of weight the packaging system can withstand. The test involved applying an external load to the packaging material to replicate the load applied during storage and transportation. The compression test included vertical compression and horizontal compression (clamping simulation). Specifically, and "apply and hold dead weight" method was used. In this, a total weight ($W_t$) of the packaged item was 239 lbs., a total number of packed products in stack (S) was 2 (with a stack height of 192 inches), and a compensating factor (F) was 3. The actual test load was 717 lbs., calculated using $W_t$, S, F (e.g., (239×(2−1)×3)), and the duration of test was 1 hour. In the horizontal compression, a Forklift Clamp Force of 900 lb. was used. The packed item was lifted at a height of 12 inches for 30 seconds, which was repeated for 6 times. No damage to the item was detected during the first testing procedure.

A second testing procedure (vibration test procedure (fixed displacement)) included testing at a frequency of 4.5 Hz and a time duration of 44 minutes. Specifically, the procedure included putting the packed item on a vibration table such that a bottom face rested on a platform (such that the packed item rests vertically on the platform) and starting the vibration system to vibrate at 1.0 inch (25 mm) total displacement at the machine's lowest frequency. The procedure further included maintaining a fixed displacement at 1.0 inch (25 mm) and slowly increasing the frequency (speed) of the table until the packed item begins to momentarily leave the surface of the platform. A metal shim was made to intermittently move between the bottom of the longest dimension of the packed item and the surface of the platform. The procedure further included holding that frequency for the test duration to achieve 11,800 vibratory impacts. No damage to the item was detected during the second testing procedure.

A third testing procedure (shock test procedure) included free fall drop of the packed item. In this procedure, the packed item was dropped from a height of 8 inches in a vertical orientation. No damage to the item was detected during the third testing procedure.

A fourth testing procedure included vibration procedure ("Burst Test" Fixed Displacement). Specifically, the procedure included putting the packed item on a vibration table such that a bottom face rests on a platform (such that the packed item rests vertically on the platform). The procedure further included starting the vibration system to vibrate 1 inch displacement peak to peak for 10 seconds at 5 Hz frequency. 10 repetitions were conducted and the target force was 1.27 g. In this test procedure, no top load was used in this procedure. No damage to the item was detected during the fourth testing procedure.

A fifth testing procedure included vibration procedure (horizontal ship test). The procedure included putting the packed item on a vibration table such that a sidewall/face rests on a platform (such the packed item rests horizontally on the platform). In this procedure, ISTA 3H Steel Spring Truck was used for a duration of 12 minutes (2 sides), and overall grams level was of 0.54. No damage to the item was detected during the fifth testing procedure.

A sixth testing procedure included shock procedure (Rotational Edge Drop). The procedure included releasing an edge of the packed item so that it falls freely onto the flat, rigid surface (e.g., a drop height of 8 inches). No damage to the item was detected during the sixth testing procedure.

A seventh testing procedure included vibration procedure (Random Vertical Orientation). The procedure was conducted for 4 hours and overall grams level was of 0.54. An eighth testing procedure included determining stability (e.g., tip over measurement). The procedure included measuring all 4 faces, and identifying stability if tip angle for all 4 faces is greater than 22 degrees. No damage to the item was detected during the seventh and eighth testing procedures.

After conducting the above-mentioned, the packed item was inspected. During inspection, no visible damage to the item was found. The packaging system and the item remain intact throughout all testing procedures.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A packaging system for an item, the packaging system comprising:

an inner box having at least one sidewall configured to enclose one or more side surfaces of the item, wherein the at least one sidewall comprises an interior surface and an exterior surface;

at least one spacer attached to the exterior surface of the at least one sidewall, wherein the at least one spacer comprises a first spacer attached vertically at a middle portion of the exterior surface of the at least one sidewall such that a longitudinal axis of the first spacer is parallel to a longitudinal axis of the inner box, and wherein the first spacer comprises a first cut-out configured to access one or more accessories associated with the item; and an outer box configured to enclose the inner box and the at least one spacer of the at least one sidewall.

2. The packaging system of claim 1, wherein the inner box and the outer box are corrugated boxes.

3. The packaging system of claim 1, wherein the at least one spacer comprises a honey-comb corrugated support.

4. The packaging system of claim 1, wherein the at least one spacer further comprises a second spacer attached horizontally on the exterior surface such that a longitudinal axis of the second spacer is perpendicular to an inner box longitudinal axis.

5. The packaging system of claim 4, wherein the second spacer is attached at a top portion or a bottom portion of the exterior surface.

6. The packaging system of claim 1, wherein the inner box comprises a second cut-out to access a portion of the item.

7. The packaging system of claim 6, wherein the outer box comprises a removable panel or flap configured to access the portion of the item, and wherein the removable panel or flap is aligned with the cut-out.

8. The packaging system of claim 1, wherein the inner box further comprises one or more third cut-outs to accommodate the one or more accessories associated with the item, and wherein the first cut-out of the first spacer is aligned with the one or more third cut-outs.

9. The packaging system of claim 1 further comprising a pallet having a plurality of supports, wherein the plurality of supports is disposed on a top surface of the pallet, and wherein the plurality of supports is configured to surround a base of the item.

10. The packaging system of claim 1 further comprising a top cap configured to cover a top portion of the item, wherein the top cap is a corrugated cap.

11. The packaging system of claim 1, wherein the item is a water heater.

12. The packaging system of claim 1, wherein the inner box or the outer box comprises a rip cord disposed on at least one sidewall of the inner box or the outer box.

13. The packaging system of claim 1, wherein the first spacer covers 10-70% of a height of the at least one sidewall.

14. The packaging system of claim 13, wherein the first spacer covers 40-60% of the height of the at least one sidewall.

15. A packaging system for an item, the packaging system comprising:

an inner box having a plurality of sidewalls configured to enclose side surfaces of the item, wherein each sidewall comprises an interior surface and an exterior surface, and wherein the inner box further comprises one or more cut-outs to access one or more portions of the item;

at least one spacer attached to the exterior surface of each sidewall, wherein the at least one spacer comprises a first spacer attached vertically at a middle portion of the exterior surface such that a longitudinal axis of the first spacer is parallel to a longitudinal axis of the inner box, and wherein the first spacer comprises a second cutout aligned with the one or more cut-outs of the inner box such that second cutout is configured to access the one or more portions of the item; and an outer box configured to enclose the inner box and the at least one spacer of each sidewall.

16. The packaging system of claim 15, wherein the inner box and the outer box are corrugated boxes.

17. The packaging system of claim 15, wherein the at least one spacer further comprises a second spacer attached vertically at a top portion or a bottom portion of the exterior surface.

18. A method to package an item, the method comprising:

positioning the item on a pallet;

placing an inner box around the item to enclose side surfaces of the item, wherein the inner box comprises at least one spacer on an exterior surface of the inner box, wherein the at least one spacer comprises a first spacer attached vertically at a middle portion of the exterior surface of the inner box such that a longitudinal axis of the first spacer is parallel to a longitudinal axis of the inner box, and wherein the first spacer comprises a cut-out configured to access one or more portions of the item; and placing an outer box around the inner box to enclose the inner box and the at least one spacer.

* * * * *